United States Patent [19]

Tattershall

[11] Patent Number: 4,783,071

[45] Date of Patent: Nov. 8, 1988

[54] GOLF COURSE PIN DISTANCE DETERMINATION DEVICE

[76] Inventor: Harold D. Tattershall, 3585 Rancho Vista Way, Sacremento, Calif. 95834

[21] Appl. No.: 84,344

[22] Filed: Aug. 12, 1987

[51] Int. Cl.[4] ..... A63B 67/02

[52] U.S. Cl. ..... 273/32 H; 273/176 L; 283/34; 434/252

[58] Field of Search ..... 273/32 H, 176 L; 283/34; 434/252, 153

[56] References Cited

U.S. PATENT DOCUMENTS

| | | | |
|---|---|---|---|
| 3,552,290 | 1/1971 | Brechtel | 273/176 L |
| 3,685,168 | 8/1972 | Reitz | 273/32 H X |
| 3,805,411 | 4/1974 | Andrews, Jr. | 273/176 L X |
| 3,820,786 | 6/1974 | Candor | 273/32 H |
| 3,937,466 | 2/1976 | Candor | 273/32 H |
| 3,949,987 | 4/1976 | Candor | 273/176 L |
| 4,247,994 | 2/1981 | Cullen, Jr. | 434/153 |
| 4,331,425 | 5/1982 | Davis, Jr. | 273/176 L X |
| 4,419,655 | 12/1983 | May | 273/176 L X |
| 4,505,478 | 3/1985 | Riethmiller | 273/32 H |
| 4,655,451 | 4/1987 | Townsley | 273/32 H |
| 4,666,156 | 5/1987 | Wakisaka | 273/32 H |
| 4,666,157 | 5/1987 | Bodine et al. | 273/32 H |

FOREIGN PATENT DOCUMENTS

| | | | |
|---|---|---|---|
| 158185 | 10/1985 | European Pat. Off. | 273/32 H |

*Primary Examiner*—Paul F. Neils

*Attorney, Agent, or Firm*—Lothrop & West

[57] ABSTRACT

A device for determining distance to the pin on the green of a golf hole is disclosed which incorporates an aerial schematic representation of the entire hole, upon which is superimposed a series of concentric distance calculation arcs centered at a key location point on the apron adjacent the green, in combination with a detailed aerial schematic representation of the green, upon which a scaled rectilinear grid and second representation of the adjacent location point appear. A board for posting current positions of pins for all greens of a golf course is also disclosed to be used in updating the schematic representation of the green for each hole for accurate distance calculation to the pin from substantially any point on the golf course.

7 Claims, 2 Drawing Sheets

GOLF COURSE PIN DISTANCE DETERMINATION DEVICE

BACKGROUND OF THE INVENTION

1. Field of the Invention

The present invention relates generally to golf course distance determination devices, and more specifically to such devices employing a scaled map or schematic diagram of one or more holes of a particular golf course in combination with indicia from which true ground distance may be calculated.

2. Description of the Related Art

Most golfers would agree that one of the most difficult aspects of golf strategy is distance determination. Therefore, various devices employ scaled maps or schematic aerial views of golf course holes in combination with indicia allowing determination of ground distances. For example, U.S. Pat. No. 3,552,290 issued Jan. 5, 1971 to Frederick Charles Brechtel discloses a method of making such maps and applying arcuate indicia for distance determination. U.S. Pat. No. 3,805,411 issued Apr. 23, 1974 to Charles C. Andrews discloses a scorecard in combination with a scaled golf course map depicting ground distance indicia at particular topographical features. U.S. Pat. No. 3,949,987 issued Apr. 13, 1976 to James T. Candor discloses a combination of sheets, scaled overlays and arcuate indicia for simulation of particular golf holes. And U.S. Pat. No. 4,505,478 issued Mar. 19, 1985 to Mark R. Riethmiller discloses concentric circular bands for measurement of golf course ground distances.

Frequent relocation of the pin, and consequently the cup, which is the golfer's true objective on the putting green, is necessary to avoid excess wear in any one spot. Changes in position of up to 50 yards or more are possible. Yet, while this source of imprecision in golf course distance determination is often acknowledged in the related art, it is routinely overlooked; and all distances to the pin are, in fact, calculated with reference to the green's center, or otherwise approximated. Thus, further accuracy is sacrificed to avoid daily recalculation and republication of course distances.

U.S. Pat. No. 3,685,168 issued on Aug. 22, 1972 to Edward G. Reitz discloses a stationary relief model of a green for analysis of topography and shot direction employing a moveable marker to designate the instant location of the pin. However, while the device of Reitz discloses measured coordinates on the relief model corresponding to actual distances on the green, no connections with other distances over the surface of the golf hole are offered. Nor is a device disclosed that a golfer can carry with him to make "on the spot" calculations of distance and direction.

SUMMARY OF THE INVENTION

The improved golf course distance determination device of the present invention enables a golfer accurately to calculate the true present distance to the pin from any point on a golf hole.

Two main elements, in combination, are employed to this end. A first element, the golfer's position map, consists of a scaled map of at least one golf hole schematically depicting the tee, the fairway and the putting green, along with other common features such as sand traps, water hazards, roads, trees and rough. Superimposed on the golfer's position map is a series of distance calculation arcs corresponding to actual measurement at ground level and uniformly distributed over the length of the golf hole. The arcs are centered at a fixed location point that corresponds to the actual surveyed point on the apron of the green found intersecting that point on the green closest to the tee, hereinafter referred to as the surveyor's reference point.

A second element, the pin position map, consists of a very detailed scaled map of only the putting green portion of the same golf hole depicted in the golfer's position map. Superimposed thereupon is a rectilinear grid of scaled lines from which accurate distances over the surface of the green may be calculated. The pin position map also includes a second fixed location point corresponding to the fixed location point of the golfer's position map. Thus, the two fixed location points constitute a nexus, or link, in orientation between the golfer's position map and the pin position map. Further disposed upon the pin position map is a temporary mark placed to illustrate the instant location of the pin and cup on the putting green.

Use of the two maps together allows a golfer to calculate with accuracy distances from anywhere on the golf hole to the instant location of the pin and cup on the putting green. Thus, one object of the present invention is to provide a golf distance determination device useful for calculating with equal accuracy both the longer course distances encountered when executing tee and mid-fairway shots, and the shorter distances encounted when approaching the green or putting.

Another object of the invention is to provide a golf course distance determination device with accurate, up-to-date information about the pin location on the putting green, thereby facilitating precise distance calculation for the golfer's approach shot to the pin from outside the green area.

A further object of the invention is to provide a golf course distance determination device that facilitates optimum club selection for the golfer's approach shot to the pin from outside the green area.

Yet another object of the invention is to provide a golf course distance determination device in pocket-sized booklet form wherein each page includes first, a golfer's position map of one particular hole of an actual golf course, suitably enhanced with color to promote easy identification of all features thereon, and second, an inset on each page depicting the corresponding pin position map for the green of the hole, whereupon an eraseable mark can be made to illustrate the instant location of the pin as depicted daily on a master pin position chart posted in a central location on the course.

The golf course distance determination device of the present invention has other objects and features which will be apparent from, and are set forth in more detail in, the accompanying drawings and the following description of the preferred embodiment.

DESCRIPTION OF THE PREFERRED EMBODIMENT

Figure 1:
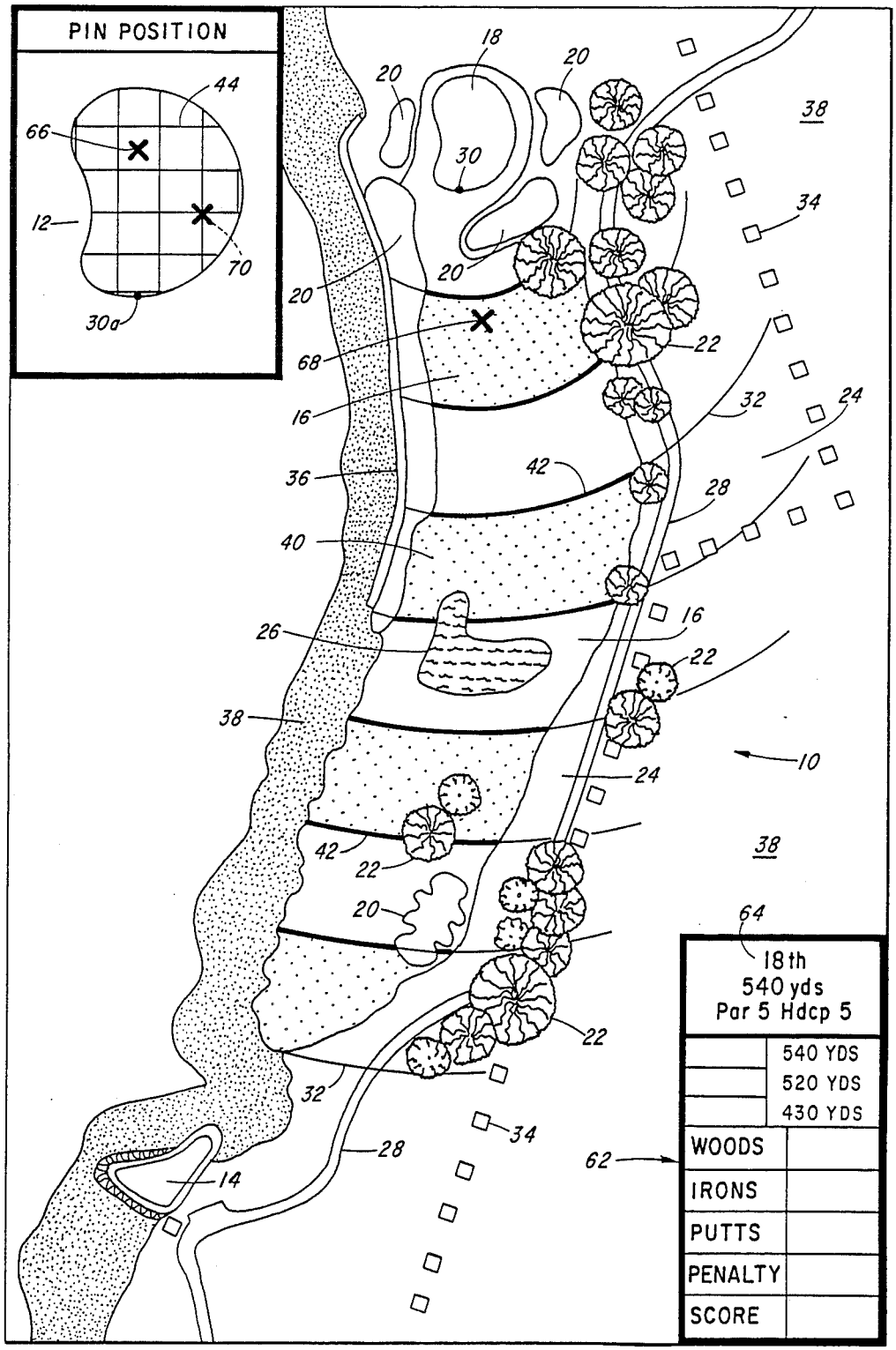
FIG. 1 is a plan view of the present golf course pin distance determination device incorporating both a golfer's position map and an inset pin position map for a particular golf hole.

Referring to the drawings, FIG. 1 illustrates the combination of a golfer's position map 10 and a pin position map 12 for a particular hole on a golf course, in this instance, the eighteenth hole.

The golfer's position map 10 comprises a schematic aerial representation of the golf hole, depicting its essential features: a tee 14, a fairway 16 and a green 18. All are disposed upon the golfer's position map 10 in scale relation to their actual counterparts on the golf hole's surface, as are other incidental topographical features of natural and artificial origin such as sand traps 20, trees 22, rough 24, a water hazard 26 and a road 28. Various colors may also be employed to distinguish further each of these features from the others.

The golfer's position map 10 also has a distance calculation mechanism superimposed thereupon. The key element of the distance calculation mechanism is a fixed location point 30. The fixed location point 30 on the golfer's position map 10 corresponds to a surveyor's established ground reference point which is that point on the green's apron closest to the tee.

Radiating outward from the fixed location point 30, and superimposed upon substantially the length of the entire representation of the golf hole, is a series of concentric distance calculation arcs 32. The arcs 32 describe regular intervals corresponding to actual measurement at ground level in numbers of yards susceptible to being easily mentally multiplied. The arcs 32 of the preferred embodiment are disposed in 50 yard increments. The distance calculation arcs 32 span the width of the entire playing area of the hole, and, as can be seen by reference to FIG. 1, even extend well into the rough 24 where many golfers spend much of their time. The lateral limits of the distance calculation arcs 32 are generally formed by boundaries such as a fence 34 and a wall 36 that delineate out of bounds areas 38.

The preferred embodiment of the golfer's position map 10 also includes a stippled pattern 40 applied to intervals of fairway 16 between arcs 32 in alternating fashion to afford ease in counting distance increments described by arcs 32. To facilitate further the counting of distance increments, that section of each arc 32 traversing the fairway 16 may be depicted as a thickened colored band 42, each such band 42 being of a different color and matching a like-colored post, or a plurality thereof, placed at locations on the surface of the golf course corresponding to distances described by arcs 32 bearing such bands 42.

The pin position map 12, appearing in the upper left-hand corner of FIG. 1, comprises a detailed scaled map of only the putting green portion of the same golf hole depicted in the golfer's position map 10. Superimposed on the pin position map 12 is a rectilinear grid of lines 44 of known scale and therefore capable of relation to the scale of the golfer's position map 10 as well as to distances over the surface of the actual green. The grid 44 of the pin position chart 12 disclosed in FIG. 1 is of 10 yard increments. The preferred embodiment, however, employs 5 yard increments for added accuracy.

The pin position map 12 includes a fixed location point **30*a* corresponding to both the fixed location point 30 of the golfer's position map and the surveyor's ground reference point on the apron of the green. Thus, the two respective fixed location points 30 and 30*a* constitute a nexus, or link, in orientation between the golfer's position map 10 and the pin position map 12. Consequently, as will be discussed more fully below, a mark made upon the pin position map 12** to designate the current precise location of the pin also facilitates accurate calculation of distance to that point from any other point on the golf hole.

Although preferably disposed upon a single sheet for ease of reference, the golfer's position map 10 and the pin position map 12 may occupy separate sheets without loss of accuracy in use.

Figure 2:
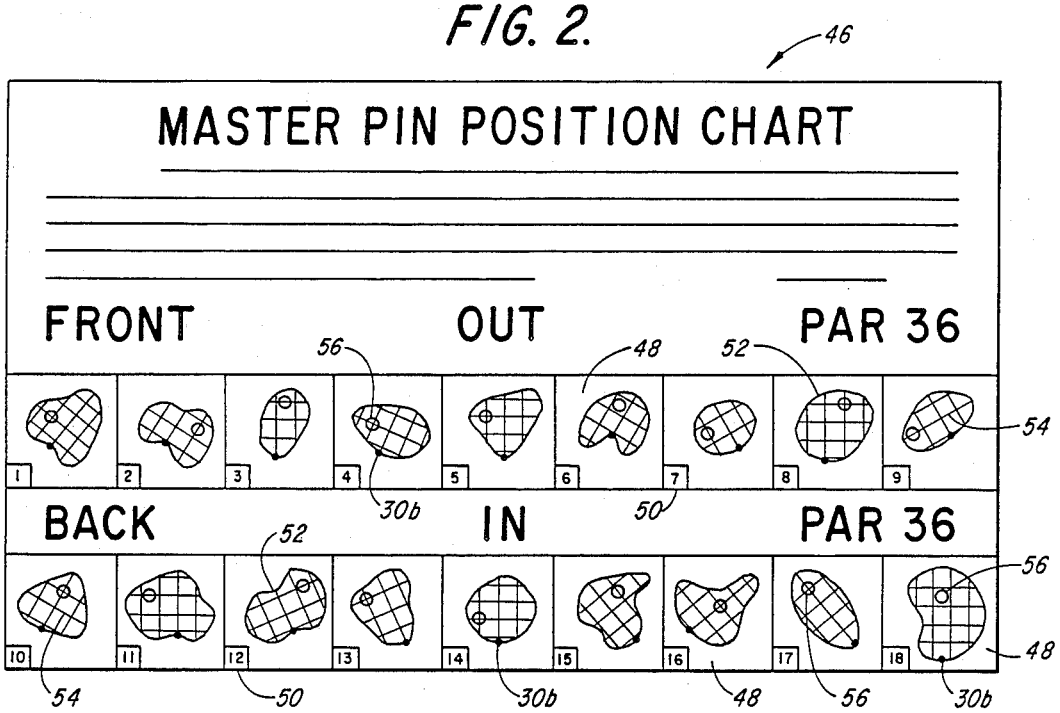
FIG. 2 is a plan view of a master pin position chart from which golfers learn the daily positions of the pins for recording as temporary marks upon the pin position maps for all holes on a course.

FIG. 2 illustrates an additional element of the preferred embodiment, as master pin position chart 46, used for posting the present pin location for all greens on a given golf course. Said pin position chart 46 is essentially a collection of all, usually eighteen, pin position maps 12 for that course, and is preferably constructed to an enlarged scale.

For clarity, each of these enlarged maps of an individual putting green, when displayed upon the master pin position chart 46, will be referred to as a pin locator 48. The pin position chart 46 includes eighteen of such pin locators 48 each of which is an accurate representation of the eighteen different putting greens. Each pin locator 48 is marked with its respective hole number 50 for identification, and each includes a scale map of a single putting green 52 upon which is disposed a rectilinear grid of scaled lines 54 drawn, preferably, so that each unit thereof corresponds to the same measurement in yards as on its corresponding pin position map 12. The grid 54 of the pin locator 48 disclosed, for example, in FIG. 2 is of 10 yard increments. As prevously indicated however, the preferred embodiment employs 5 yard increments for added accuracy.

FIG. 2 also reveals that each pin locator 48 of the master pin position chart 46 incorporates a third representation **30*b* of the fixed location point which serves as an orientation device for cross reference to the respective fixed location point 30*a* of each pin position map 12, and to the respective fixed location point 30 of each golfer's position map 10**.

The master pin position chart 46 serves as a posting place for the current positions of all pins for all holes on the golf course. Therefore, its placement in a central, easily accessible location on the golf course is desirable. The clubhouse or tee area of the first golf hole are suggested as good posting locations; and since the master pin position chart 46 is enlarged in size, golfers availing themselves of the present device can readily and conveniently read the chart and mark the pin locations on their pin position maps 12 at the beginning of the round.

The posting mechanism contemplated is preferably a moveable marker 56 placed upon the grid 54 of each pin locator 48 map depicted on the master pin position chart 46. Each movable marker 56 is placed to illustrate the current position of the pin on a respective single putting green. Possible placement means for each moveable marker 56 include attraction of a magnetic marker 56 to a pin position chart 46 of ferrous metal or cooperating hook and loop fabric means which adhere when pressed together.

Figure 3:
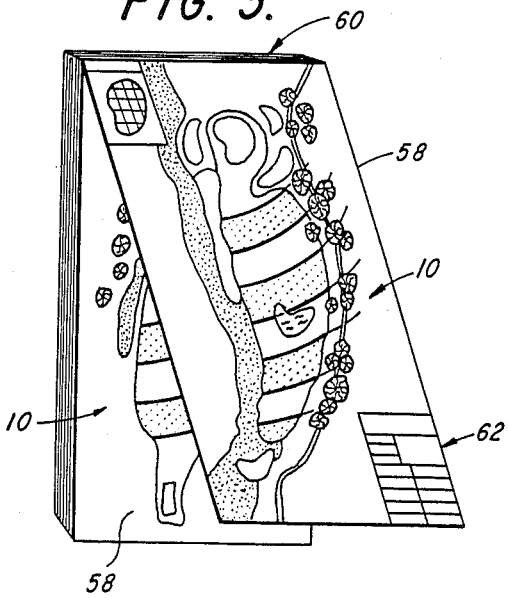
FIG. 3 is a perspective view of an end-bound, pocket-sized booklet, each page of which depicts a golfer's position map and an inset pin position map for one golf hole; and, FIG. 4 is a plan view of a portion of a master pin position chart depicting a second possible pin position for the illustrative 18th hole golfer's position map depicted in FIG. 1.

FIG. 3 discloses an additional aspect of the preferred embodiment: namely, display of the golfer's position map 10 and the pin position map 12 for each golf hole on a single page 58 of a pocket-sized booklet 60. For convenience, each booklet page 58 also includes a scoring chart 62 with an annotation 64 as shown in FIG. 1 indicating the golf hole number of the maps 10 and 12 for cross reference to the corresponding pin locator 48 on the pin position chart 46.

In some cases, it is desirable that each page 58, or sheet, upon which a golfer's position map 10, a pin position map 12 and a scoring chart 64 appear, be coated with a durable material having a surface permitting eraseable marking thereon. With this type of booklet construction, the score and the location of the pins can be marked by an eraseable pencil, such as a graphite or grease pencil.

Successful operation of the device first requires that when the golf course staff changes the location of a pin to prevent wear on one part of a putting green, they record that change on the respective pin locator 48 of the master pin position chart 46. For example, should the pin of the 18th hole (depicted in FIG. 1) be relocated, the golf course staff would first determine with precision its new location with respect to the surveyor's reference point on the apron of the green. That new location would then be indicated on the pin position chart 46 by changing the location of the moveable marker 56 to that shown on pin locator 48 map number 18, as appears most clearly in FIG. 2.

Before beginning a round of play, a golfer would consult the pin position chart 46, and make a mark at the same point on the grid 44 of the pin position map 12 of each page 58 of booklet 60 as corresponds to the moveable marker's 56 position on the grid 54 of each pin locator 48. The mark 66, such as an "x", made by the golfer on the pin position map 23 of FIG. 1 for the 18th hole would correspond to its position as depicted for that particular hole by the circular mark 56 on the master pin position chart 46 in FIG. 2.

After a tee shot and one or more intermediate shots, a golfer might find his ball in the position indicated by numeral 68 on FIG. 1. By consulting the golfer's position map 10, and by comparing his position on the course relative to such features as adjacent trees, sandtraps or colored posts, and perhaps by pacing off distances therefrom, the golfer can determine that his ball lies 10 yards to the tee side of the first of the distance calculation arcs 32. Since the distance between the fixed location point 30 and the first of the arcs 32 on the golfer's position map 10 indicates a course distance of 50 yards, addition and extrapolation allow the golfer to determine that his ball lies approximately 60 yards from the surveyor's reference point located on the apron of the green.

To calculate the total distance to the present location of the pin, the golfer next needs to consult the pin position map 12. As shown in FIG. 1, the golfer's mark 66 on the pin position map 12 shows the pin to be three and one half 10 yard grid increments beyond fixed location point 30*a*, for a real putting green distance of 35 yards. Addition of the results of both calculations, and extrapolation to actual ground distance, yields the total distance from the golfer's present lie to the pin: namely, 95 yards. Such information allows the golfer confidently to choose a club, and to adjust his swing power for maximum accuracy when approaching the pin.

Figure 4:
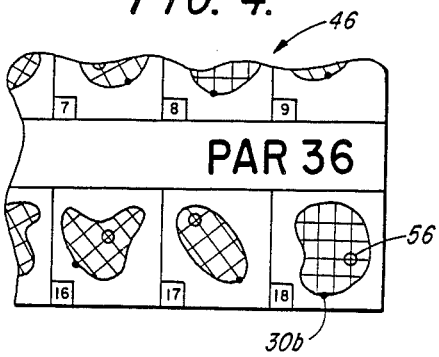

FIG. 4 illustrates a second example of golf course distance determination employing the present device. If the moveable marker 56 of the partial pin position chart 46 of FIG. 4 shows the current pin position of the 18th hole to be disclosed therein, rather than in the location illustrated in FIG. 2, the golfer would make a corresponding mark 70 on the pin position map 12, as shown in broken line in FIG. 1. Assuming the same ball position 68 as in the first example, the distance to the surveyor's reference point is still 60 yards. Reference to the pin position map 12 reveals that the pin's current placement is two full yard grid increments beyond fixed location point 30*a* for a real, or actual, green distance of 20 yards. Addition of the results of both calculations, and extrapolation to actual ground distance, yields the total distance from the golfer's present lie to the pin; namely, 80 yards.

It is noted that the assumed new pin position 70 is also one and one half 10 yard grid increments to the right of fixed location point 30*a*. Thus, the pin is 20 yards beyond and 15 yards to the right of the surveyor's reference point on the green. Thus, when topographical features obscure the position of the pin from the view of the golfer in his position on the golf hole, reference may be had to the pin position map for aid in directional calculation as well as distance calculation. Further, if a golfer needs to make an approach shot to the green from an oblique angle with respect to the grid 44 on pin position map 12, he needs merely to remember that the diagonal distance from corner to corner of a grid square is approximately 1.4 times the rectilinear distance increment of the grid. Accordingly, the distance of most ball flight paths to the pin may be estimated with considerable accuracy.

The foregoing detailed disclosure of the description and operation of the device is to be considered merely illustrative of preferred embodiments of, and not as a limitation upon, the scope of the invention.

Those skilled in the art will envision many other possible variations. For example, they may use different distance scales to indicate course distances on golfer's position maps 10, pin position maps 12 and pin locators 48. They may post the pin position chart 46 as a photocopied handout with which golfers may update a booklet of golfer's position maps 10. The booklet 60 may also include textual matter, such as tips on playing each hole from the local golf professional and advertising matter. Said booklet 60 might also be side bound, ring bound, spring bound or glue bound.

Use of the golfer's position map 10 for calculation of all distances on the golf hole, including tee shots, is contemplated, although its forte is found in calculating distances of approach shots to the pin. Accordingly, the scope of the invention should be determined with reference to the appended claims, and not by the examples which have been given.

Thus, I have provided an accurate, yet simple and portable device for determining the distance from any position on a golf hole to the precise current location of the pin.

I claim:

1. A golf course pin distance determination device comprising a plurality of map sheets correlated to the holes of a golf course, said map sheets including, for each hole, a. a first map depicting an aerial representation of a golf hole;

b. a first point on said first map corresponding to an established reference point on the ground adjacent the putting green of the golf hole;

c. a plurality of concentric arcs on said first map, said arcs being centered on said first point and spaced apart predetermined radial distances scaled to the respective actual distances on the ground;

d. a second map depicting to an enlarged scale the putting green portion of said golf hole as appears on said first map;

e. a second point on said second map corresponding to said first point on said first map, said first point and said second point being located at the portion of the putting green closest to the tee of said golf hole;

f. a scaled grid on said second map; and, g. means for indicating on said second map the present position of the pin on the putting green.

2. A device as in claim 1 in which said arcs span the opposite boundaries of said golf hole as delineated on said first map.

3. A device as in claim 1 in which a plurality of first maps and second maps are compiled in a pocket-sized booklet.

4. A device as in claim 1 in which said first maps and said second maps are coated with a durable material having a surface allowing eraseable marking thereon.

5. A device as in claim 1 including a master pin position chart having a plurality of pin locator maps representing the respective ones of said putting green maps; and means for indicating on each of said pin locator maps the present location of the pin on the respective actual putting green.

6. A device as in claim 5 including a third point on said each of said pin locator maps corresponding to said first point on said first map and said second point on said second map.

7. A golf course pin distance determination device comprising a plurality of map sheets correlated to the holes of a golf course, said map sheets including, for each hole, a. a position map depicting a first aerial representation of a golf hole including a tee, fairway, puting green, rough, hazards and other topographic features and landmarks;

b. a fixed location point on said position map corresponding to a surveyor's reference mark placed on the portion of the apron of the actual putting green closest to the tee;

c. a series of concentric distance calculation arcs on said position map centered at said fixed location point and extending over the golf hole toward the tee, the arcs being spaced apart a scaled distance corresponding to the actual ground distance from the surveyor's reference mark;

d. means for indicating the present position of the golf ball on said position map;

e. a pin position map depicting a second aerial representation to an enlarged scale of the putting green portion of said golf hole as appears on said position map including said fixed location point;

f. a scaled grid on said pin position map; and, g. means for marking on said grid the position of the pin corresponding to the actual present location of the pin on the putting green, the total distance from the golf ball to the pin on the actual golf hole being determined by adding the scaled distances from the ball to said fixed location point on said position map and from said fixed location point to the pin on said pin position map.

* * * * *